US005402212A

United States Patent [19]

Ito et al.

[11] Patent Number: 5,402,212

[45] Date of Patent: Mar. 28, 1995

[54] IMAGE FORMING APPARATUS HAVING PROCESS CARTRIDGE WHICH IS AUTOMATICALLY MOUNTABLE

[75] Inventors: Akira Ito, Tokyo; Naoki Yamazaki, Machida, both of Japan

[73] Assignee: Canon Kabushiki Kaisha, Tokyo, Japan

[21] Appl. No.: 123,204

[22] Filed: Sep. 20, 1993

Related U.S. Application Data

[63] Continuation of Ser. No. 885,659, May 19, 1992, abandoned.

[30] Foreign Application Priority Data

May 20, 1991 [JP] Japan ..... 3-142742
May 11, 1992 [JP] Japan ..... 4-117605

[51] Int. Cl.[6] ..... G03G 15/01
[52] U.S. Cl. ..... 355/210; 355/245
[58] Field of Search ..... 355/200, 210, 211, 245, 355/326 R, 327

[56] References Cited

U.S. PATENT DOCUMENTS 4,598,992 7/1986 Landa et al. ..... 355/211
4,708,455 11/1987 Kubota et al. ..... 355/211
4,841,329 6/1989 Kasamura et al. ..... 355/326 X
4,996,566 2/1991 Morita et al. ..... 355/326 X
5,047,803 9/1991 Kanoto ..... 355/211
5,053,820 10/1991 Preszler et al. ..... 355/245
5,182,595 1/1993 Fukuchi et al. ..... 355/200

FOREIGN PATENT DOCUMENTS 63-149669 12/1986 Japan .
0230165 9/1990 Japan .

*Primary Examiner*—Robert B. Beeatty
*Attorney, Agent, or Firm*—Fitzpatrick, Cella, Harper & Scinto

[57] ABSTRACT

A process cartridge removably mountable within an image forming apparatus, includes a frame, an image bearing body provided in the frame, a process device also provided in the frame and acting on the image bearing body, and an engagement portion. The engagement portion of the process cartridge is adapted to be engaged with a mounting portion of the image forming apparatus when the process cartridge is positioned at a predetermined mounting position, by utilizing a driving force from a drive source within the image forming apparatus. An image forming apparatus includes the mounting portion for mounting the removable process cartridge, a drive source for driving the process cartridge into mounted and dismounted positions, a mounting member for directing the process cartridge toward the mounting portion and a damper for dampening a shock received by the process cartridge. The image forming apparatus further includes a resilient pressing device for pressing against the mounted process cartridge so as to maintain the cartridge in a predetermined processing position. Mounting and dismounting of the process cartridge with respect to the image forming system can be effected automatically.

13 Claims, 8 Drawing Sheets

IMAGE FORMING APPARATUS HAVING PROCESS CARTRIDGE WHICH IS AUTOMATICALLY MOUNTABLE

This application is a continuation of application Ser. No. 07/885,659, filed May 19, 1992, now abandoned.

BACKGROUND OF THE INVENTION

1. Field of the Invention

The present invention relates to a process cartridge and an image forming system (image forming apparatus).

2. Related Background Art

Hereinafter, a color process cartridge and a color image forming system will be described as an example.

In the past, color image forming systems wherein toner images formed on an image bearing member are sequentially superimposed on a moving transfer sheet carried for endless movement have been already known. In such a color image forming system, a process cartridge is constituted by integrally incorporating the image bearing member, a plurality of developing devices and the like into a single housing as a unit which can be removably mounted within the color image forming system, thus facilitating the maintenance.

By the way, since the plurality of developing devices incorporated in the cartridge are disposed around the image bearing member, the image bearing member has as substantial dimension. Thus, as the weight of the image bearing member becomes greater, increases the weight of the whole cartridge increases.

Accordingly, greater force is required for an operator to lift the cartridge and to mount it within the image forming system, with the result that not only is the operator's burden increased, but also the cartridge is subjected to the unnecessary shock during the mounting of the cartridge within the image forming system and results in the scattering of toner. Further, although the color cartridge typically is larger in size due to multiple developing devices, if any cartridge becomes large-sized, the same problems will occur.

SUMMARY OF THE INVENTION

An object of the present invention is to provide a process cartridge and an image forming system, which can improve the operability regarding the mounting of the process cartridge within the image forming system.

Another object of the present invention is to provide a process cartridge and an image forming system, which can improve the operability regarding the dismounting of the process cartridge within the image forming system.

A further object of the present invention is to provide a process cartridge and an image forming system, in which the mounting and dismounting of the process cartridge with respect to the image forming system can be effected automatically.

A still further object of the present invention is to provide a color process cartridge and a color image forming system, in which the mounting and dismounting of the color process cartridge including an image bearing member and a plurality of developing means for performing the development with different colors with respect to the image forming system can be effected automatically.

A further object of the present invention is to provide a color image forming system which can reduce the operator's burden regarding the mounting and dismounting of a cartridge and to relieve the shock against the cartridge to eliminate the inconvenience such as the scattering of toner.

Another object of the present invention is to provide a color image forming system within which a cartridge having a housing integrally incorporating therein at least an image bearing member, a plurality of developing devices and a cleaning device can be removably mounted and which has a mounting and dismounting mechanism for performing the mounting and dismounting the cartridge automatically.

DETAILED DESCRIPTION OF THE PREFERRED EMBODIMENTS

The present invention will now be explained in connection with embodiments thereof with reference to the accompanying drawings.

Figure 1:
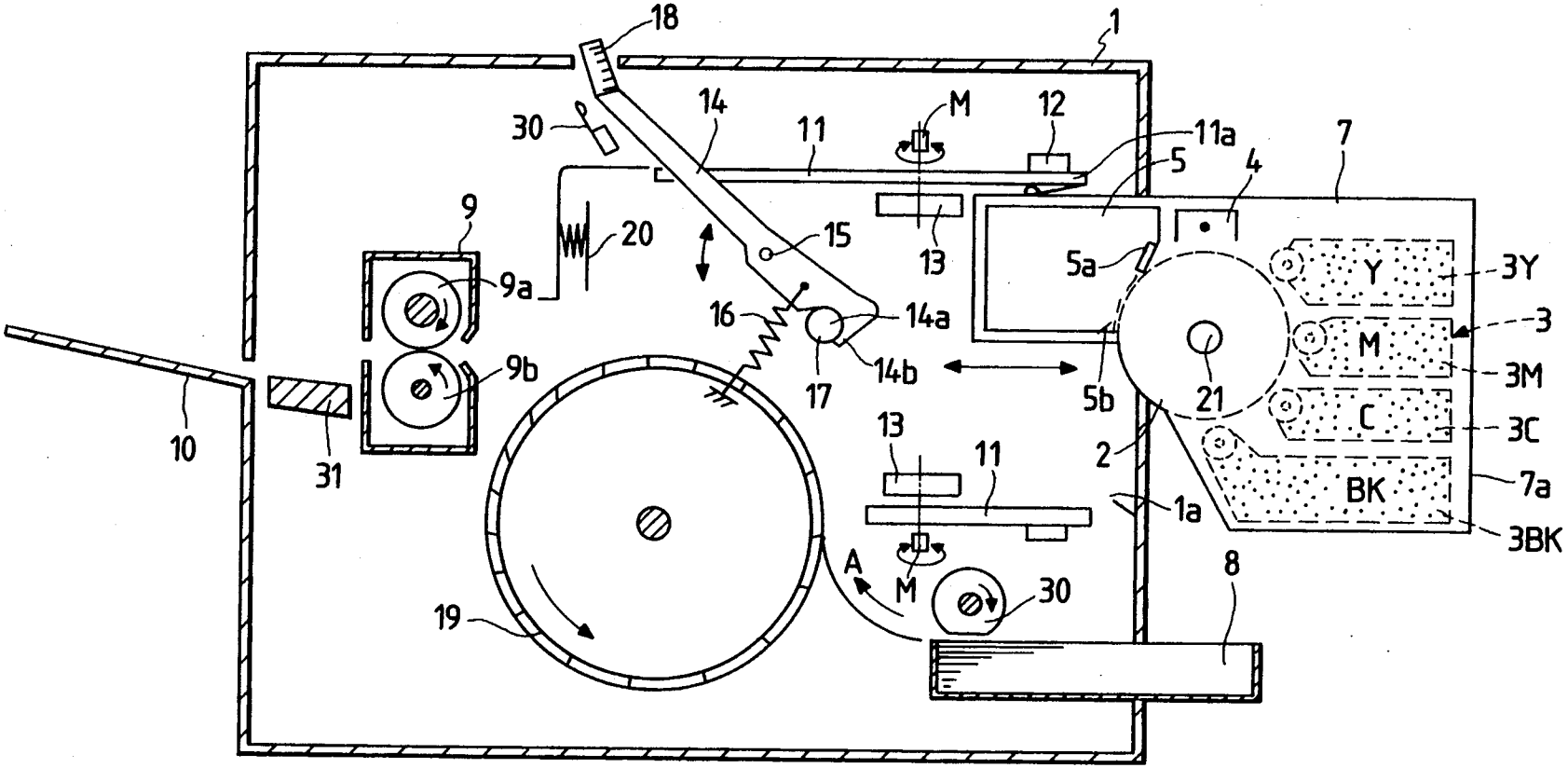
FIG. 1 is an elevational sectional view of a laser beam printer according to a preferred embodiment of the present invention.
Figure 2:
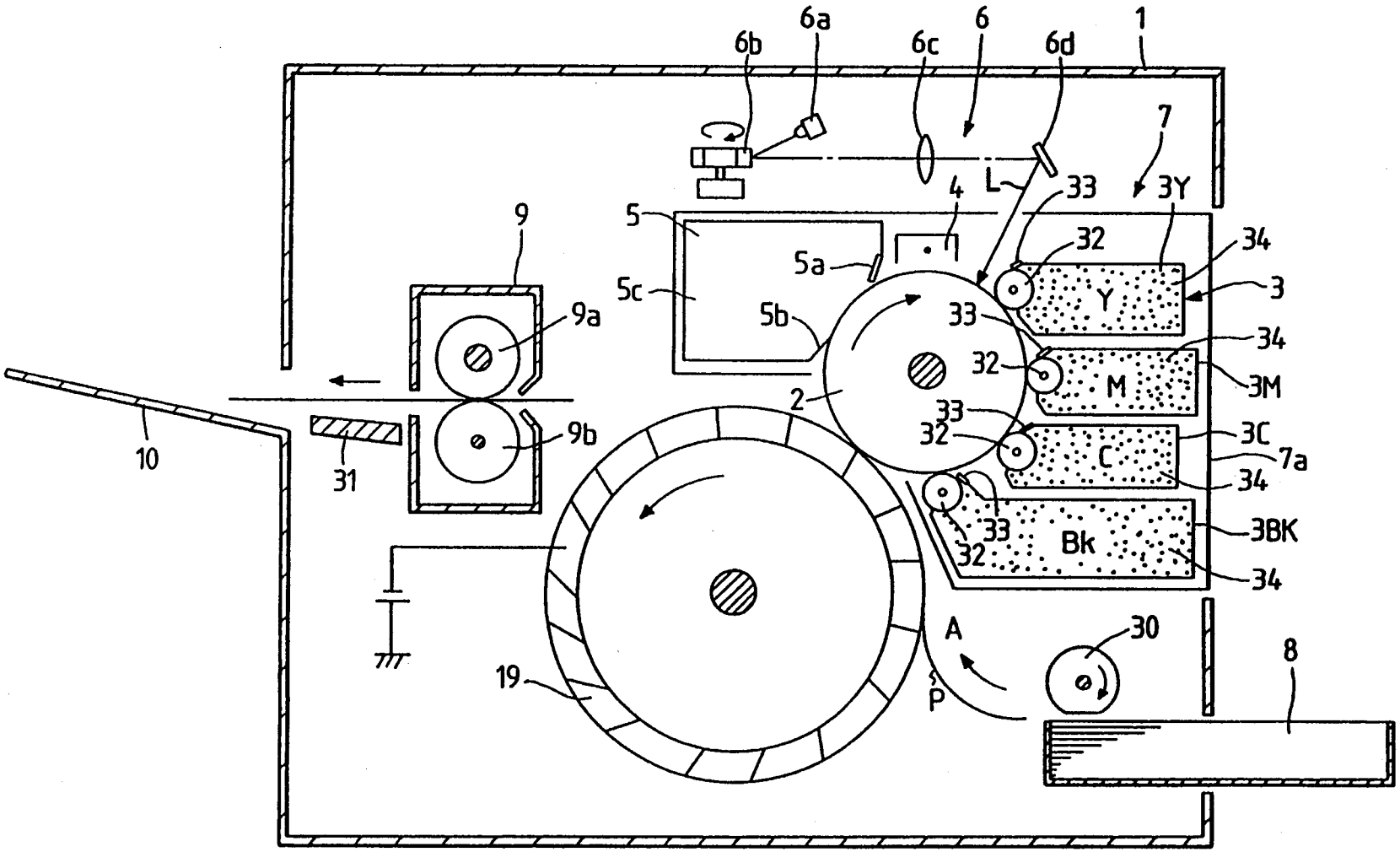
FIG. 2 is an elevational sectional view similar to FIG. 1, but showing a condition that a process cartridge is mounted within the laser beam printer.

FIG. 1 is an elevational sectional view showing a construction of a mounting and dismounting mechanism of a color image forming system, and FIG. 2 is an elevational sectional view of the color image forming system. Incidentally, the color image forming system may be a copying machine, laser beam printer and the like which can obtain a color image by using the electrophotographic technique; hereinafter, a laser beam printer will be explained as an example.

First of all, the construction of the color image forming system (laser beam printer) according to a preferred embodiment of the present invention will be briefly described with reference to FIG. 2. Incidentally, in FIG. 2, a cartridge mounting and dismounting mechanism (described later) is omitted from illustration.

In FIG. 2, a cartridge 7 is adapted to be removably mounted within the laser beam printer 1 and has a housing *7a* integrally incorporating therein an image bearing member (for example, a photosensitive drum) 2, a plurality of developing devices 3 (3Y, 3M, 3C, 3BK), a primary charger 4 and a cleaning device 5; these devices 3, 4, 5 being arranged around the image bearing member 2. Further, an optical system 6, a transfer drum 19, a sheet supply cassette 8 and a fixing device 9 are disposed within the laser beam printer 1. Now, the developing device 3Y serves to perform the development with yellow toner (Y), the developing device 3M serves to perform the development with magenta toner (M), the developing device 3M serves to perform the development with cyan toner (C), and the developing device 3BK serves to perform the development with black toner (BK). Each developing device has a developing sleeve 32, a doctor blade 33 and a toner reservoir 34.

When the image bearing member 2 is uniformly charged by the primary charger 4 and then is illuminated by light L such as a laser beam emitted from the optical system 6, a latent image corresponding to image information is formed on a surface of the image bearing member 2. The latent image is firstly developed by the developing device 3Y to form an yellow toner image. Incidentally, the optical system 6 includes a laser generator **6*a*, a polygonal mirror 6*b*, a lens 6*c* and a mirror 6*d*. Further, the cleaning device 5 includes an elastic cleaning blade 5*a*, a receiving sheet 5*b* and a waste toner reservoir 5*c***.

On the other hand, a sheet P contained in the sheet supply cassette 8 is supplied one by one by the rotation of a sheet supply roller 30 in a direction shown by the arrow A. Then, the sheet P is held by the transfer drum 19 and is passed between the image bearing member 2 and the transfer drum 19, where the yellow toner image formed on the image bearing member 2 is transferred onto the sheet. Thereafter, latent images similarly formed on the image bearing member 2 are developed by the developing devices 3M, 3C, 3BK to form magenta, cyan and black toner images, respectively. These toner images are sequentially transferred onto the same sheet that is carried on the transfer drum 19 by grippers (not shown), thus forming a full-color image.

After the plural transferring operations as mentioned above are finished, the sheet P is separated from the transfer drum 19 by releasing the grippers (not shown) to reach the fixing device 9, where the full-color toner image is permanently fixed to the sheet. Thereafter, the sheet is ejected onto an ejection tray 10 out of the printer. Incidentally, after the transferring operations, the residual toner remaining on the image bearing member 2 is removed by the cleaning device 5. The fixing device 9 comprises a heat roller **9*a* and a pressure roller 9*b*. The reference numeral 31** denotes a guide.

Next, a mounting and dismounting mechanism for automatically mounting and dismounting the cartridge 7 with respect to the laser beam printer 1 will be explained with reference to FIG. 1. Incidentally, in FIG. 1, the optical system is omitted from illustration.

In the laser beam printer 1, upper and lower parallel guides 11 are disposed, and a sensor 12 for detecting the mounting and dismounting of the cartridge is arranged at one end **11*a* (near a cartridge insertion opening 1*a* of the printer 1) of the upper guide 11. Further, rollers 13 adapted to engage by lateral side walls of the cartridge 7 and to shift the cartridge to a predetermined position along the guides 11 are rotatably supported by the guides 11. These rollers 13** are appropriately rotated by a drive source M.

Further, in the printer 1, a lock plate 14 for positioning and securing the cartridge 7 is rotatably supported on a shaft 15 for pivotal movement in direction shown by the arrow and is biased by a spring 16 toward a predetermined direction (clockwise direction). In a condition that the cartridge 7 is not mounted within the printer 1 as shown in FIG. 1, an engagement pawl **14*a* formed on one end of the lock plate 14 is engaged by a shaft 17. The lock plate 14 is provided at its other end with a lock releasing lever 18. Incidentally, in FIG. 1, the reference numeral 20 denotes a damper for absorbing the shock generated during the mounting of the cartridge 7**.

In the mounting operation for mounting the cartridge 7 within the laser beam printer 1, when an operator inserts the cartridge 7 in a direction shown by the arrow through the cartridge insertion opening **1*a* of the printer 1, the cartridge 7 is detected by the sensor 12. When a detection signal from the sensor 12 is sent to a control portion 100, the latter emits a drive signal for driving the rollers 13, thereby rotating the rollers 13. The rollers 13 are abutted against the side walls of the cartridge 7 and convey the cartridge 7 toward the interior of the printer 1 along the guides 11. When a shaft 21 protruded from the side wall of the cartridge 7 is abutted against an inclined surface 14*b* of the lock plate 14, the shaft pushes the lock plate to rotate the latter around the shaft 15, thus lifting the lock plate until the engagement pawl 14*a* of the lock plate 14 is engaged by the shaft 21. When the engagement pawl is engaged by the shaft 21, the cartridge 7 is positioned and held within the laser beam printer 1. At the same time, the movement of the lock plate 14 is detected by a photo-sensor 30 and the rollers 13 are stopped by a stop signal emitted from the control portion 100 when the latter receives a detection signal from the sensor 30. In this way, the mounting of the cartridge 7 within the laser beam printer 1** is effected automatically.

On the other hand, when the cartridge 7 is dismounted from the laser beam printer 1, the operator manipulates the lock releasing lever 18 so that the engagement pawl **14*a* of the lock plate 14 disengages from the shaft 21. In this case, the movement of the lock releasing lever 18 is detected by the sensor 30, and the rollers 13 are rotated reversely by a drive signal emitted from the control portion 100 when the latter receives a detection signal from the sensor 30. As a result, the cartridge 7 is returned toward the cartridge insertion opening 1*a* by the rotational driving force of the rollers 13 along the guides 11. In this way, the cartridge 7 can be dismounted from the laser beam printer 1 automatically. Incidentally, the rotation of the rollers 13 may be stopped after a predetermined time period (from the initiation of such rotation) is elapsed under the control of the control portion 100**.

As mentioned above, according to the illustrated embodiment, the cartridge 7 can be automatically mounted and dismounted with respect to the laser beam printer 1 by means of the mounting and dismounting mechanism. Thus, it is possible to reduce the operator's burden, and to relieve the shock against the cartridge 7, thereby eliminating the inconvenience such as the scattering of the toner.

Next, another embodiment of the present invention will be explained with reference to FIGS. 3 to 7.

First of all, the whole construction of an image forming system is illustrated. Incidentally, FIG. 3 is an elevational sectional view of a laser beam printer as an example of the image forming system.

Figure 3:
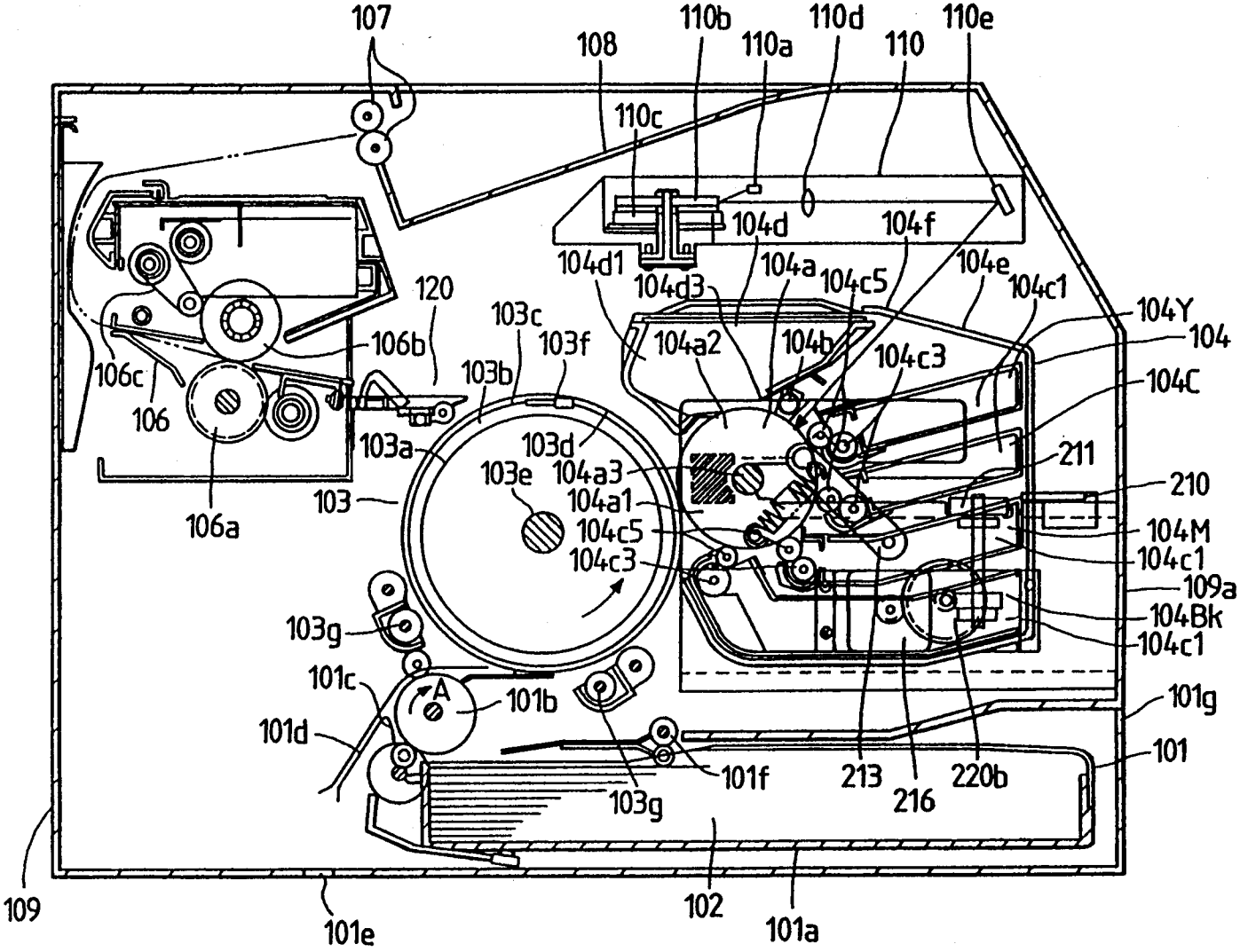
FIG. 3 is an elevational sectional view of a laser beam printer according to another embodiment of the present invention.

As shown in FIG. 3, in the laser beam printer, a recording sheet 102 supplied from a sheet supply portion 101 is wound around a transfer drum 103, and a color image is formed on the recording sheet 102 by a superimposing transferring technique at an image forming station that include a mounted process cartridge 104.

Then, the recording sheet 102 is sent to a fixing station 106, where the full-color image is permanently fixed onto the recording sheet 102. Thereafter, the recording sheet is ejected by a pair of ejection rollers 107 onto an ejection station 108 arranged on the printer.

Incidentally, the process cartridge 104 integrally includes a yellow developing device 104Y, a cyan developing device 104C, a magenta developing device 104M and a black developing device 104BK and can be removably mounted within the laser beam printer 109.

Exposure light is sent from a scanner portion 110 to the image forming station 104. That is to say, when an image signal is sent to a laser diode 110*a*, the laser emits image light corresponding to the image signal to a polygonal mirror 110*b*. The polygonal mirror 100*b* is rotated at a high speed by a scanner motor 110*c* so that an image bearing member in the process cartridge 104 is selectively exposed by the image light reflected by the polygonal mirror 110*b* via a focusing lens 110*d* and a reflection mirror 110*e*.

Next, constructural elements of the image forming system will be explained in due order.

Sheet Supply Portion

The sheet supply portion 101 serves to feed the recording sheet 102 to the image forming station and is constituted by a sheet supply cassette 101*a* containing a plurality of recording sheets and mounted on a bottom of the laser beam printer 109 within thereof. During the image formation, the sheet supply roller 101*b* is rotated in synchrony with the image forming movement to separate and feed the recording sheet 102 one by one from the cassette 101*a* and to send the recording sheet to the transfer drum 103 via a guide plate 101*c*.

Incidentally, a guide plate 101*d* shown in FIG. 3 serves to guide a recording sheet 102 supplied, via an insertion opening 101*e*, from a cassette (not shown) mounted on an outer surface of the bottom of the laser beam printer 109. Further, a sheet supply roller 101*f* serves to feed a recording sheet 102 manually supplied through an insertion opening 101*g*.

The transfer drum 103 holds the recording sheet 102 wound therearound and is rotated in a direction shown by the arrow in FIG. 3 to transfer various color toner image on the recording sheet 102. The transfer drum 103 according to this embodiment comprises an aluminum core cylinder 103*a*, an inner elastic layer 103*b* made of elastic material such as sponge or rubber, an intermediate conductive layer 103*c* and an outer dielectric layer 103*d*. The transfer drum 103 is rotatably supported within the laser beam printer 109 via a drum shaft 103*e* and is rotated in the direction shown by the arrow in FIG. 3 by a drive force from a drive motor via a drum gear (not shown) secured to the transfer drum 103.

Further, a gripper 103*f* is provided on an outer peripheral surface of the transfer drum 103 at a predetermined position to hold a leading end of the recording sheet 102, and an electrostatic adsorption roller 103*g* which can be engaged by and disengaged from the peripheral surface of the transfer drum 103 is urged against the transfer drum 103 with the interposition of the recording sheet 102. By applying a voltage between the roller 103*g* and the conductive layer 103*c* of the transfer drum 103, the electric charges are induced in the recording sheet 102, which is a dielectric body, and the dielectric layer 103*d* of the transfer drum 103, thus electrostatically attracting the recording sheet 102 on the peripheral surface of the transfer drum 103.

Incidentally, the adsorption of the recording sheet 102 onto the transfer drum 103 is not limited to the above-mentioned electrostatic adsorption but may be effected by an air suction technique.

Process Cartridge

The process cartridge 104 includes at least an image bearing member 104*a* and a developing means for developing an image formed on the image bearing member 104*a*. For example, the process cartridge may integrally include an image bearing member, and process means such as a charger means, developing means and cleaning means as a unit which can be removably mounted within the image forming system, or may integrally include an image bearing member, a developing means, and at least one of process means such as a charger means or cleaning means as a unit which can be removably mounted within the image forming system, or may integrally include an image bearing member and a developing means as a unit which can be removably mounted within the image forming system.

As shown in FIG. 3, the process cartridge 104 according to this embodiment is constituted by a charger means 104*b*, four developing means 104Y, 104M, 104C and 104BK containing yellow toner (developer) Y, magenta toner M, cyan toner C and black toner BK, respectively, and a cleaning means 104*d* arranged around an electrophotographic photosensitive drum (image bearing member) 104*a* and covered by a cartridge cover 104*e* to form a unit or cartridge which can be removably mounted within the image forming system 109.

Next, the constructural elements of the process cartridge 104 will be described.

(Photosensitive Drum)

The photosensitive drum 104*a* comprises an aluminium core cylinder 104*a*1 and an organic photoconductive layer 104*a*2 coated on an outer peripheral surface of the cylinder, and is rotatably supported by the cartridge cover 104*e* via a rotary shaft 104*a*3. Further, a driving force from a drive motor (not shown) is transmitted to a gear (not shown) secured to one end of the rotary shaft 104*a*3 of the photosensitive drum 104*a*, thus rotating the photosensitive drum in a direction shown by the arrow in FIG. 3 in synchronous with the image forming operation.

(Charger Means)

The charger means 104*b* may be of a so-called contact charging type, as disclosed in the Japanese Patent Appln. Laid-open No. 63-149669, for example. The charger comprises a conductive roller urged against the photosensitive drum 104*a* and adapted to uniformly charged the surface of the photosensitive drum 104*a* by applying a voltage to this conductive roller. Incidentally, the process cartridge 104 is provided with an exposure opening 104*f* through which the image light from the scanner portion 110 is illuminated on the charged photosensitive drum 104*a* to form a latent image on the drum.

(Developing Means)

In order to visualize the latent image, there are provided four developing means for performing the development with yellow, magenta, cyan and black colors.

These four developing means 104Y, 104M, 104C, 104BK has container 104*c*1 containing toner therein, and a toner feeding mechanism (as described in the Japanese Patent Application No. 3-268646, not shown) provided on a bottom of the container. More particularly, a reciprocal plate member having a recess or aperture enclosing the toner between the bottom of the container 104c1 and the plate member is arranged in slidingly contactable relation to the bottom of the container so that when the plate member is shifted in an advancing direction it is contacted with the bottom of the container and when the plate member is shifted in a retracted direction it is separated from the container bottom, whereby the toner is fed toward a leading end of the container. And, at the leading end of the container to which the toner is fed by the toner feeding mechanism, an applying roller 104c3, a blade (not shown) and a sleeve (developer bearing member) 104c5 are arranged. The containers 104c1 of the four developing means contain yellow toner Y, cyan toner C, magenta toner M and black toner BK, respectively, from the above in order. Incidentally, the container containing the black toner has a capacity greater than those of the other containers.

In the image formation, the developing means for performing the development with yellow, cyan, magenta and black toners, respectively, are driven in due order to form the visible toner images on the photosensitive drum 104a sequentially. That is to say, the toner in the container 104c1 corresponding to the color to be developed is sent to the applying roller 104c3 by the toner feeding mechanism, and the rotating applying roller 104c3 and the corresponding blade form a thin toner layer on the peripheral surface of the rotating sleeve 104c5 and at the same time the electric charge is applied to the toner (frictional charging). By applying the development bias between the sleeve 104c5 and the photosensitive drum 104a on which the latent image was formed, the latent image is developed to obtain the desired color toner image.

Incidentally, the above-mentioned four developing means are so positioned that the respective sleeves 104c5 and the photosensitive drum 104a are faced to each other with small gaps (of about 250 μm). The driving force is selectively transmitted to one of the developing means by a drive force switching means (not shown). That is to say, when the full-color image is formed, first of all, the developing means containing the magenta toner M is driven; whereas, the other developing means are not driven or in inoperative conditions. In this way, only the yellow toner image is formed on the photosensitive drum 104a. Similarly, by changing the drive force transmitting path by means of the drive force switching means, the cyan and yellow toner images are sequentially formed on the photosensitive drum 104a. On the other hand, when the black image is formed, the developing means containing the black toner BK is driven, thus developing the latent image on the photosensitive drum 104a only with black toner.

Further, the sleeves 104c5 of the developing means are color development high voltage sources of the image forming system 109 so that the desired voltage can be applied to the corresponding developing means selectively for each developing operation.

(Protection Cover)

Each toner image visualized on the photosensitive drum 104a by the developing means (positioned with respect to the photosensitive drum 104a) is transferred onto the recording sheet 102 carried by the transfer drum 103. Accordingly, during the image formation, the photosensitive drum 104a is exposed to face the transfer drum 103. However, because the process cartridge 104 is removable with respect to the image forming system 109, if the photosensitive drum 104a is exposed to the atmosphere when the process cartridge 104 is dismounted from the image forming system 109, the dirt and the like will adhered to the photosensitive drum and/or the photosensitive drum will be subjected to external light, thus deteriorating the photosensitive drum. To avoid this, in the illustrated embodiment, an openable protection cover (not shown) is provided on the cartridge cover 104e.

(Cleaning Means)

The cleaning means serves to remove the residual toner remaining on the photosensitive drum 104a after the toner image (visualized by the developing means) on the photosensitive drum 104a is transferred to the recording sheet 102. The residual toner remaining on the photosensitive drum 104a is scratched or swept off by the blade 103d3 during the rotation of the photosensitive drum 104a and is collected in the waste toner container 104d1.

Fixing Station

The fixing station 106 serves to permanently fix the toner image transferred from the process cartridge 104 to the recording sheet 102 wound around the transfer drum 103. As shown in FIG. 3, the fixing station includes a recording sheet conveying guide 120 a rotating drive roller 106a, and a heated fixing roller 106b urged against the drive roller for applying heat to the recording sheet 102. More particularly, while the recording sheet 102 separated from the transfer drum 103 is being passed to the fixing station 106 via the sheet conveying guide 120, the recording sheet is moved by the drive roller 106a and is subjected to heat and pressure via the fixing roller 106b. In this way, the toner image is fixed to the recording sheet 102.

Incidentally, a cleaning member 106c contacting the fixing roller 106b serves to remove the toner adhered to the fixing roller 106b.

Image Forming Operation

Next, the image forming operation effected by the above-mentioned image forming system will be described. First of all, the sheet supply roller 101b shown in FIG. 3 is rotated to pick up the single recording sheet 102 from the sheet supply cassette 101a and feed the sheet to the transfer drum 103. The transfer drum 103 rotated in the direction shown by the arrow in FIG. 3 holds the leading end of the recording sheet 102 by the gripper 103f, and the recording sheet 102 is electrostatically adhered to the peripheral surface of the transfer drum.

While the photosensitive drum 104a is being rotated in the direction shown by the arrow in FIG. 3 in synchrony with the rotation of the transfer drum 103, the surface of the drum 104a is uniformly charged by the primary charger 104b and is illuminated by the image light corresponding to a magenta image from the scanner portion 110, thus forming a magenta latent image on the photosensitive drum 104a. At the same time as the magenta latent image, the magenta developing means 104M in the process cartridge 104 is driven. By applying the voltage having the same charging polarity and substantially the same potential as that of the photosensitive drum 104a to adhere the magenta toner to the latent image on the photosensitive drum 104a, the magenta latent image is developed. Then, by applying the voltage having the polarity opposite to that of the toner to the transfer drum 103, the toner image on the photosensitive drum 104a is transferred onto the recording sheet 102 on the transfer drum 103.

Incidentally, during the development and transfer of the magenta image, the cyan, yellow and black developing means are not driven.

After the transferring of the magenta toner image as mentioned above is finished, the cyan, yellow and black latent images are formed and then developed sequentially, and then, the toner images so formed are transferred onto the same recording sheet sequentially in the similar manner regarding the magenta image, thereby forming the full-color image on the recording sheet 102. Then, the recording sheet 102 is separated from the transfer drum 103 and is sent to the fixing station 106, where the full-color image is fixed to the recording sheet. Thereafter, the recording sheet is ejected onto the ejection tray 108 by the paired ejector rollers 107, thus finishing the image forming operation.

Mounting and Dismounting of Process Cartridge for Exchange

Next, the automatic mounting and dismounting of the process cartridge 104 with respect to the image forming system 109 will be described with reference to FIG. 3 and FIGS. 4 to 7.

Figure 4:
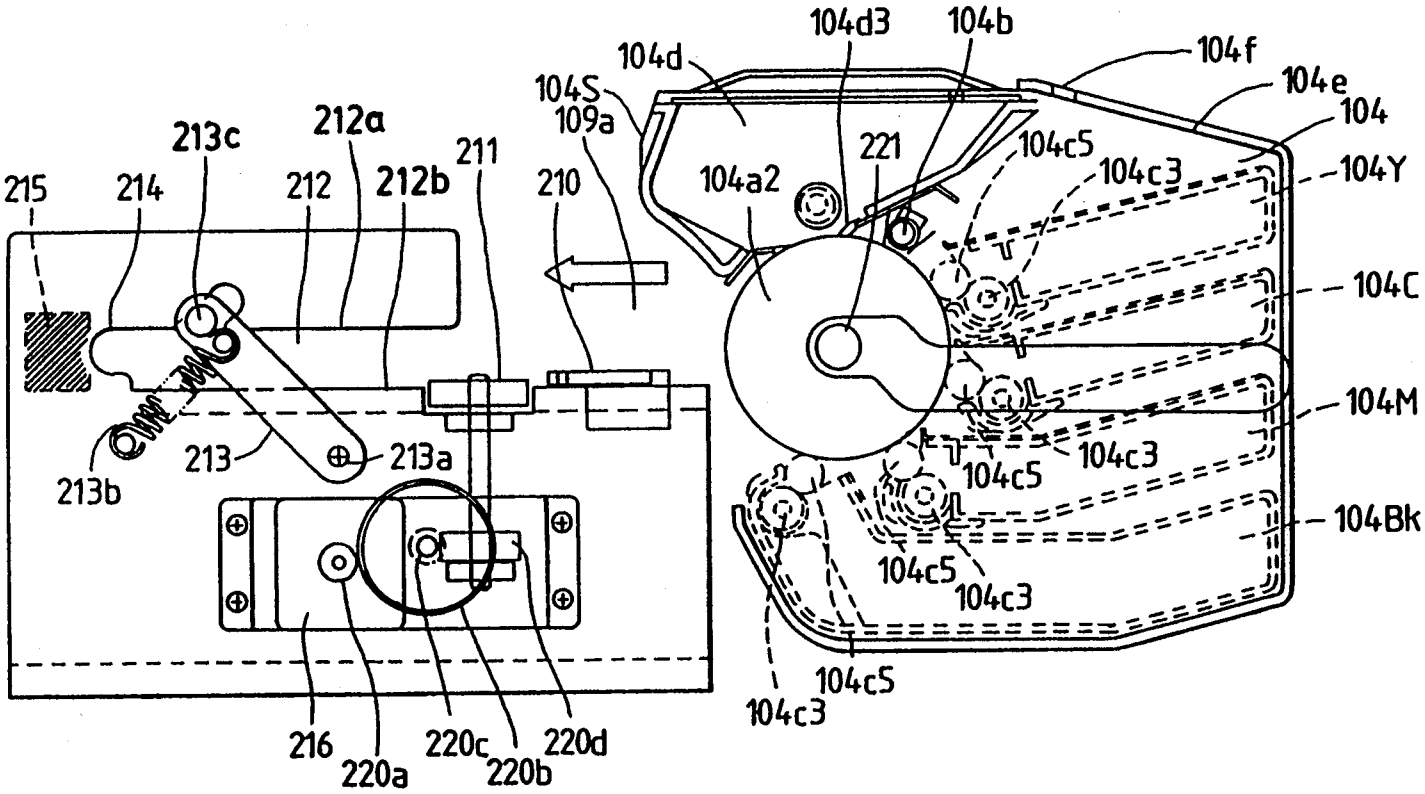
FIG. 4 is an elevational view of a process cartridge mounting and dismounting mechanism.
Figure 5:
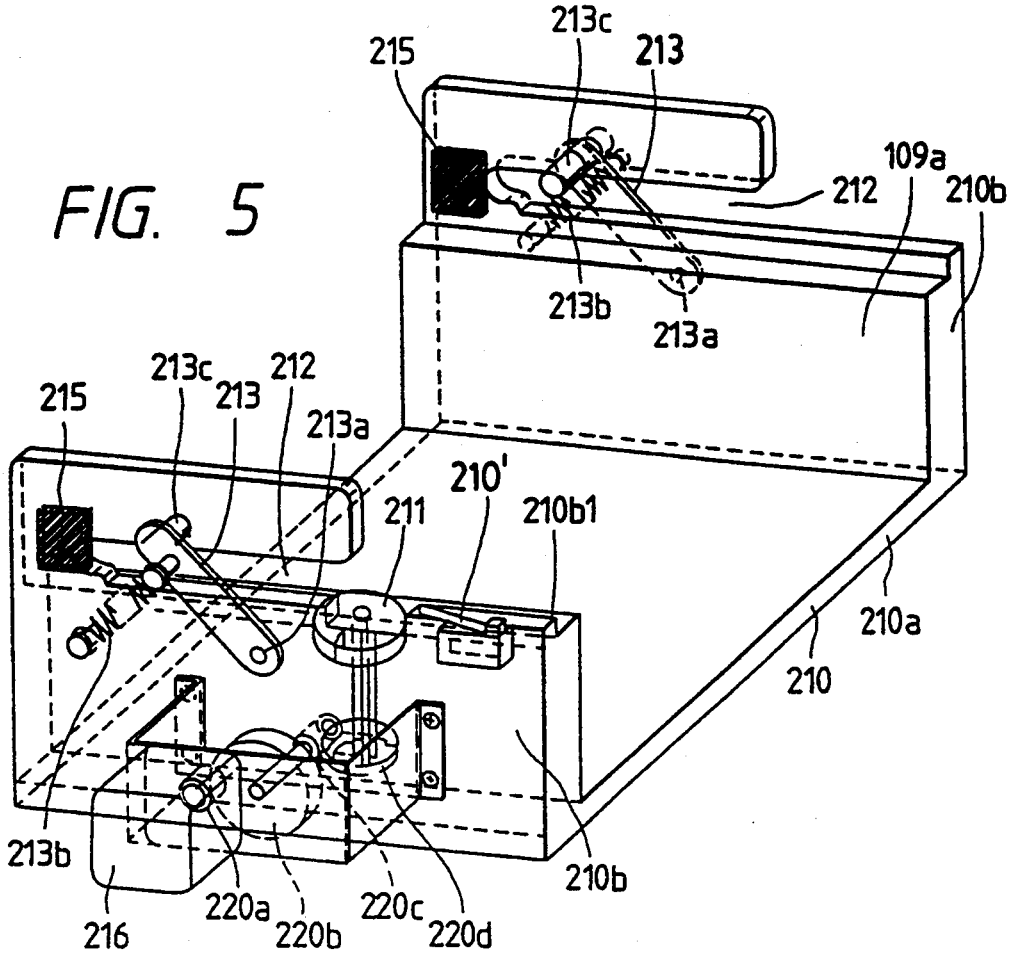
FIG. 5 is a perspective view of the process cartridge mounting and dismounting mechanism.
Figure 6:
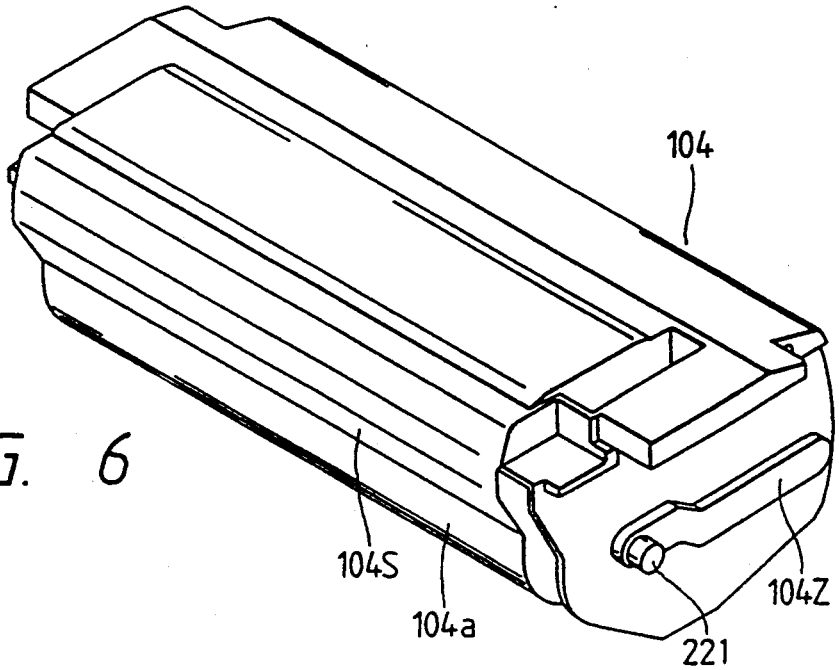
FIG. 6 is a perspective view of a process cartridge.
Figure 7:
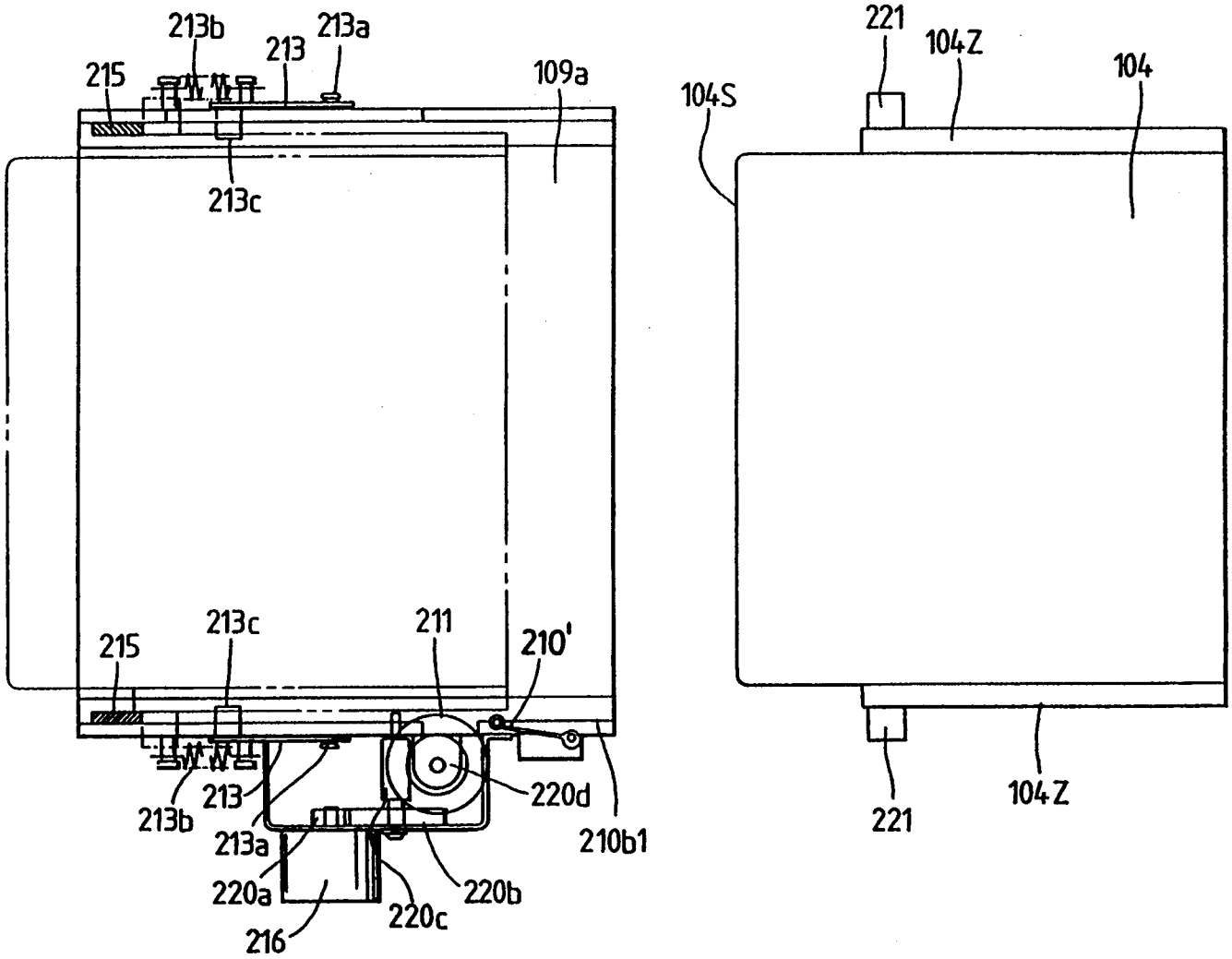
FIG. 7 is a plan view of the process cartridge mounting and dismounting mechanism.

Incidentally, FIG. 4 is an elevational view of a process cartridge mounting and dismounting mechanism of the image forming system; FIG. 5 is a perspective view of such mechanism; FIG. 6 is a perspective view of the process cartridge; and FIG. 7 is a plan view of the process cartridge mounting and dismounting mechanism.

As shown in FIGS. 4 to 7, a cartridge mounting base 210 for mounting the cartridge 104 has a bottom plate 210*a* and lateral vertical side plates 210*b*. Guide slots 212 are formed in the side plates 210*b* for guiding the process cartridge 104. Further, a detection sensor 210' is arranged on one of the side plates 210*b* in front of the guide slot 212 thereof. A roller 211 is disposed at a downstream side of the detection sensor 210' in a cartridge inserting direction. A peripheral surface of the roller 211 protrudes inwardly from an inner side wall 210*b*1 of the side plate 210*b* so that it can be engaged by a side surface 104*z* of the cartridge 104 when the latter is inserted. A rotational driving force of a motor 216 is transmitted to the roller 211 via gears 220*a*, 220*b*, 220*c*, 220*d*, thus rotating the roller 211. Lock plates 213 are rotatably supported on corresponding shaft 213*a* in association with the guide slots 212 and are biased toward an anticlockwise direction by means of corresponding springs 213*b*. Lock plates 213 and springs 213*b* comprise a resilient urging means. Each lock plate 213 is provided at its free end with a pin 213*c* protruding inwardly of the corresponding side plate 210*b*. When the cartridge 104 is mounted and dismounted along the guide slots 212, the cartridge is prevented from floating by means of the pins 213*c* and thus, it can be shifted stably. Further, once the cartridge is positioned at a predetermined position, the dismounting of the cartridge is prevented since it is locked by the pins 213*c*. Incidentally, elastic members 215 are arranged at inner or base ends of the guide slots 212 for absorbing the shock generated when the cartridge is mounted.

Next, the operation for mounting and dismounting the cartridge with respect to the image forming system will be explained.

When the operator inserts a leading end 104S of the cartridge 104 into a cartridge insertion opening 109*a* in order to set the cartridge in the image forming system 109, the movement of a protruded side surface 104*z* of the cartridge is detected by the sensor 210'. When a detection signal from the sensor is inputted to the control portion 100 (shown in FIG. 10), the latter emits a drive signal for driving the roller 211, thus rotating the roller 211 in a direction that the cartridge 104 is inserted into the image forming system 109. Since the roller 211 is rotated while contacting with the side surface 104Z of the cartridge, the cartridge 104 is directed toward the interior of the image forming system 109 along guide surfaces 212*a*, 212*b* of the guide slots 212. When shafts 21 protruding from the side surfaces of the cartridge 104 are fitted into positioning recesses 214 at the inner ends of the guide slots 212 and are resiliently urged against the recesses by the lock plates 213 and springs 213*b*, the cartridge is locked in with respect to the image forming system 109. As mentioned above, the elastic members 215 are disposed in the vicinity of the positioning recesses 214 to absorb the shock generated during the fitting of the shafts 221 between the recesses 214. When the cartridge is completely locked in, the motor 216 driving the roller 211 is subjected to the overload, which is detected by control portion 100 to stop the motor 216. In this way, the mounting or setting of the cartridge is completed.

On the other hand, when the cartridge 104 is dismounted from the image forming system, as the operator turns ON a cartridge ejection button (not shown), the control portion 100 emits a drive signal for rotating the roller 211 reversely to rotate the roller 211 in the reverse direction, thus returning the cartridge 104 toward the cartridge insertion opening 109*a* by the rotation of the roller 211 until the operator can easily dismount the cartridge from the system.

In this way, it is possible to eliminate the undesirable shock during the mounting and dismounting of the cartridge.

Incidentally, in order to ensure the more complete mounting and dismounting operation for the cartridge, small projections or indentations may be formed on either or both of the peripheral surface of the roller and the side surface of the cartridge to increase the friction force between the roller and the cartridge. Furthermore, in place of the single roller 211, a plurality of rollers may be provided, for example, in association with both side surfaces of the cartridge, In addition, to ensure the contact between the peripheral surface of the roller and the side surface of the cartridge, preferably, the peripheral surface of the roller is made to elastic material such as rubber and the like.

Next, second and third embodiments of the present invention will be explained with reference to FIGS. 8 and 9, respectively.

Figure 8:
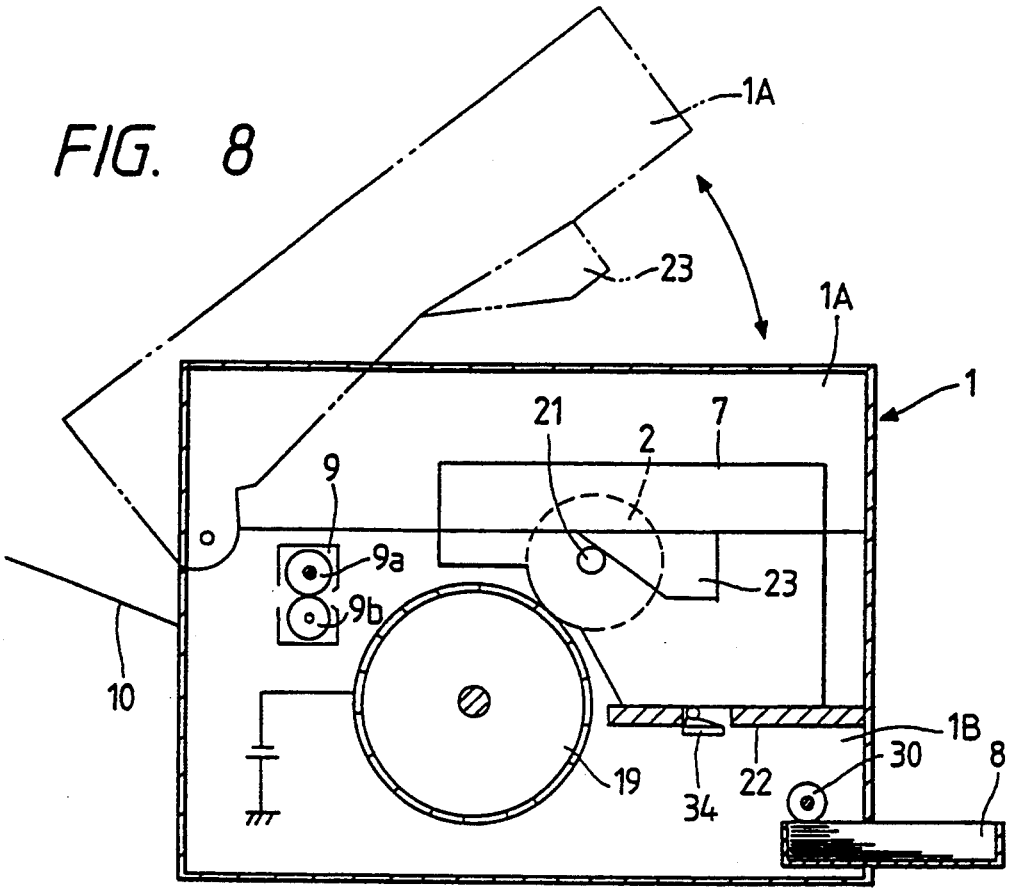
FIG. 8 is an elevational sectional view of a laser beam printer according to a further embodiment of the present invention.

A color image forming system shown in FIG. 8 is of a so-called alligator (mouth) type wherein an upper portion 1A of the system 1 can be opened with respect to a lower portion 1B. As shown in FIG. 8, in a condition that the upper portion 1A is opened, when a cartridge 7 is rested on guide portions 22 of the lower portion 1B, a sensor 34 is activated to drive a motor M1. As a result, the upper portion 1A is automatically closed via a drive gear (not shown). In this way, the cartridge 7 is automatically mounted within the image forming system 1. In this case, the cartridge 7 is pressed down by a slide plate 23 formed on the upper portion 1A, so that the operator can roughly set the cartridge 7 on the guide portions 22 (without the correct positioning of the cartridge) within a relatively wider range. Accordingly, even when the cartridge is heavy and large-sized, it is not required for the operator to correctly position the cartridge.

Figure 9:
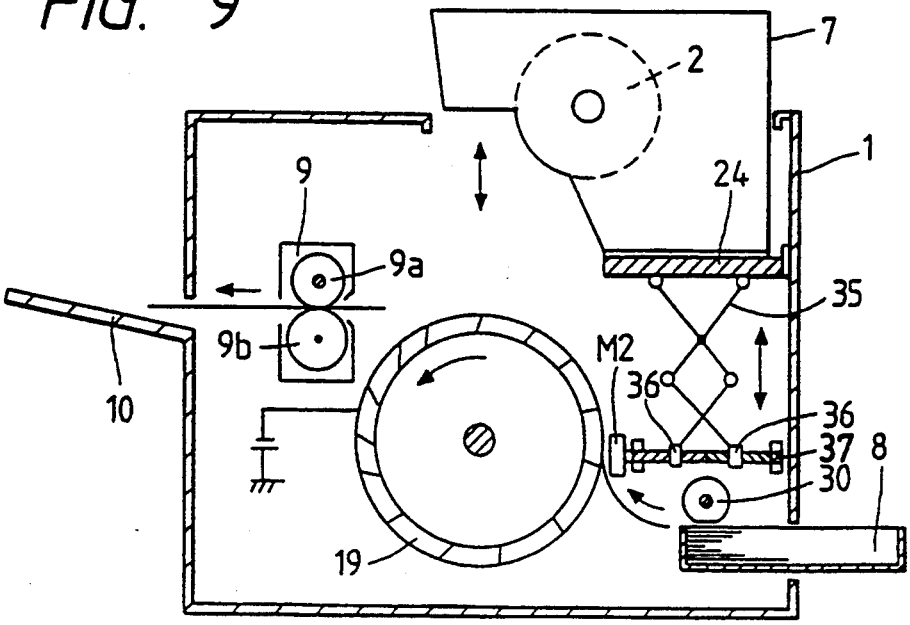
FIG. 9 is an elevational sectional view of a laser beam printer according to a still further embodiment of the present invention.

Next, a color image forming system shown in FIG. 9 is of a type wherein a cartridge 7 can automatically be mounted and dismounted with respect to the image forming system 1 by shifting a tray 24 on which the cartridge is rested in an up-and-down direction. More particularly, one end of support arm 35 is attached to the tray 24 and the other is attached to slide pieces 36. By sliding the slide pieces 36 along a threaded shaft 37 rotated by a motor M2, the tray 24 is moved in the up-and-down direction. When the slide pieces 36 are separated from each other, the tray 24 is lowered; whereas, when the slide pieces 36 are approached to each other, the tray 24 is lifted. Accordingly, even when the cartridge is heavy and large-sized, the operator may merely rest the cartridge 7 on the tray 24. Thus, the operability of the cartridge can be more improved in comparison with the case where the cartridge is shifted laterally. Also, the external force acting on the cartridge can be minimized.

Next, a function block diagram regarding the above-mentioned embodiments will be briefly explained with reference to FIG. 10.

Figure 10:
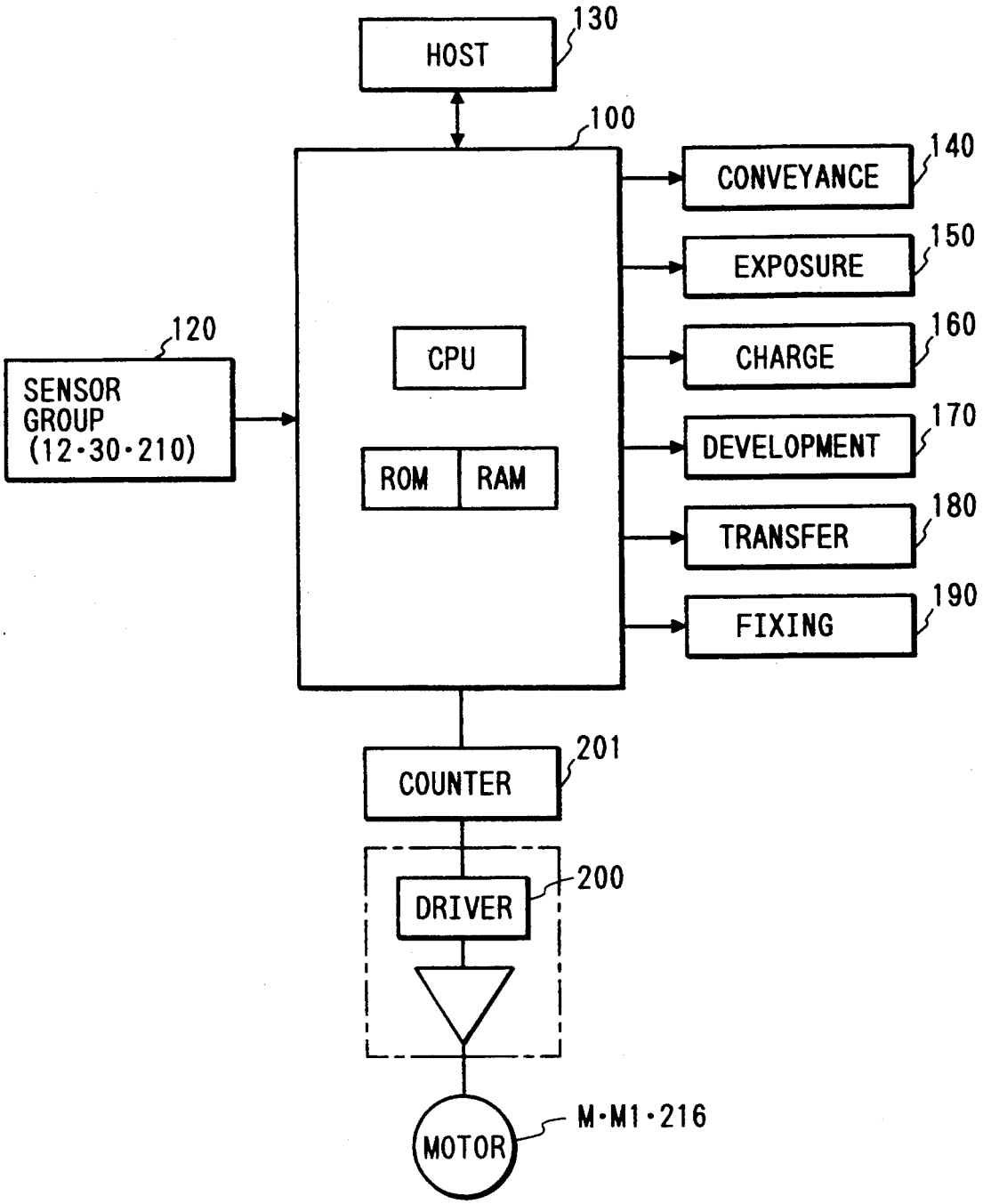
FIG. 10 is a schematic functional block diagram for controlling the operation of the laser beam printer.

In FIG. 10, a control portion 100 serves to control the whole image forming system and includes a CPU such as a microcomputer, a ROM for storing the CPU controlling program such as shown in the flow chart of FIG. 10 and various data, and a RAM used as a work area for the CPU and adapted to temporality store the various data.

The control portion 100 receives from signals from a sensor group 120 comprising the above-mentioned various sensors and a sheet jam sensor (jam sensor). On the other hand, informations such as image information and the like from a host 130 such as a computer, word processor and the like are also sent to the control portion 100. On the basis of these informations, the control portion 100 controls the above-mentioned various processes such as exposure 150 ( for example, optical system 9, scanner portion 110), charge 160 (for example, charger roller **104*b*), development 170 (for example, developing device 3, developing means 104Y, 104M, 104C, 104BK), transfer 180 (for example, transfer drum 3, 103) and fixing 190 (for example, fixing device 9, 106), and conveyance 140 for the recording sheet (for example, sheet supply roller 30, 101*b*, ejector rollers 107). Further, the control portion 100 controls the above-mentioned drive motor (M, 216, M2) via a counter 201 for counting the number of pulses sent from the control portion 100 to a driver 200**. Incidentally, when stepping motors are used as the drive motors, the motors may be driven by a predetermined number of pulses by counting such pulse number. However, when DC motors are used, for example, as mentioned above, the motors may be stopped when the overload is detected.

In the above-mentioned embodiments, while the color process cartridge was explained, the present invention may be applied to a process cartridge having a single developing device.

Incidentally, the above-mentioned process cartridge integrally incorporates therein an image bearing member such as an electrophotographic photosensitive member, and at least one of process means such as a charger means, a developing means and a cleaning means as a unit which can be removably mounted within an image forming system. More specifically, the process cartridge integrally incorporates therein a charger means, a developing means or a cleaning means, and an electrophotographic photosensitive member as a unit which can be removably mounted within an image forming system (for example, copying machine, facsimile, LBP and the like); or integrally incorporates therein at least one of process means such as a charge means, a developing means and a cleaning means, and an electrophotographic photosensitive member as a unit which can be removably mounted within an image forming system (for example, copying machine, facsimile, LBP and the like); or integrally incorporates therein at least a developing means and an electrophotographic photosensitive member as a unit which can be removably mounted within an image forming system ( for example, copying machine, facsimile, 7 LBP and the like ).

As mentioned above, according to the present invention, the mounting and dismounting of a process cartridge with respect to an image forming system can be effected automatically, thus remarkably improving the operability.

What is claimed is:

1. An image forming apparatus for forming an image on a recording medium, said image forming apparatus comprising:

a mount portion onto which a process cartridge having an image bearing member and a process means, acting on said image bearing member, is mountable;

a drive source;

mount means for introducing said process cartridge when mounted toward said mount portion by utilizing a drive force of said drive source; and resilient urging means for urging said process cartridge when mounted with a resilient force to maintain said process cartridge at a predetermined position on said mount portion.

2. An image forming apparatus according to claim 1, wherein the drive source comprises a motor.

3. An image forming apparatus according to claim 2, wherein the motor comprises a stepping motor.

4. An image forming apparatus according to claim 1, wherein said mount means comprises a roller adapted to be urged against a side of the process cartridge and to be rotated by a driving force of a motor acting as the drive source, thereby performing the mounting and dismounting of said process cartridge with respect to said image forming apparatus.

5. An image forming apparatus according to claim 1, wherein said process cartridge integrally includes the image bearing members and a plurality of developing means for different development colors as a unit which can be removably mounted within said image forming apparatus.

6. An image forming apparatus according to claim 1, wherein said process cartridge integrally includes at least one of charger means and cleaning means, and an electrophotographic photosensitive member as said image bearing member, and a plurality of developing means for different development colors as a unit which can be removably mounted within said image forming apparatus.

7. An image forming apparatus according to claim 1, wherein the process cartridge integrally includes at least one of charger means, developing means and cleaning means, and an electrophotographic photosensitive image bearing member as a unit, which can be removably mounted within said image forming apparatus.

8. An image forming apparatus according to claim 1, wherein the process cartridge integrally includes at least one of charger means, developing means and cleaning means, and an electrophotographic photosensitive image bearing member as a unit, which can be removably mounted within said image forming apparatus.

9. An image forming apparatus according to claim 1, wherein the process cartridge integrally includes at least developing means and an electrophotographic photosensitive image bearing member as a unit, which can be removably mounted within said image forming apparatus.

10. An image forming apparatus according to claim 1, further comprising damper means for dampening a shock received by said process cartridge when said process cartridge is mounted on the mount portion.

11. An image forming apparatus for forming an image on a recording medium, said image forming apparatus comprising:

a mount portion for mounting a process cartridge having an image bearing member and process means acting on said image bearing member, at an image forming position in a main body of said image forming apparatus; and displacement means for moving a process cartridge automatically to a displaced position, at which said process cartridge is exposed and protruding from said image forming apparatus, by a displacement force generated by said displacement means after said process cartridge is mounted on said image forming apparatus, wherein the displacement means includes a motor for generating the displacement force; and wherein the displacement means pushes the process cartridge upwardly from an underside of the process cartridge by the displacement force.

12. An image forming apparatus for forming an image on a recording medium, said image forming apparatus comprising:

a mount portion for mounting a process cartridge having an image bearing member and process means acting on said image bearing member, at an image forming position in a main body of said image forming apparatus; and displacement means for moving a process cartridge automatically to a displaced position, at which said process cartridge is exposed and protruding from said image forming apparatus, by a displacement force generated by said displacement means after said process cartridge is mounted on said image forming apparatus, wherein the displacement means includes a support arm movable upwardly and downwardly, said support arm moving in an up-and-down direction by the drive force from a motor to introduce the process cartridge into a predetermined image process position and into a non-processing displaced position.

13. An image forming apparatus for forming an image on a recording medium, said image forming apparatus comprising:

a mount portion for mounting a process cartridge having an image bearing member and process means acting on said image bearing member, at an image forming position in a main body of said image forming apparatus; and displacement means for moving a process cartridge automatically to a displaced position, at which said process cartridge is exposed and protruding from said image forming apparatus, by a displacement force generated by said displacement means after said process cartridge is mounted on said image forming apparatus; and damper means for dampening a shock received by said process cartridge when said process cartridge is mounted on the mount portion.

* * * * *

UNITED STATES PATENT AND TRADEMARK OFFICE

CERTIFICATE OF CORRECTION

PATENT NO. : 5,402,212

DATED : March 28, 1995

INVENTOR(S) : Ito et al.

It is certified that error appears in the above-indentified patent and that said Letters Patent is hereby corrected as shown below:

On the cover page:

Primary Examiner, "Robert B. Beeatty" should read --Robert B. Beatty--.

COLUMN 1:

Line 30, "as" (first occurrence) should be deleted--; and
Line 31, "increases" should be deleted.

COLUMN 2:

Line 12, "the" should read --of the--.

COLUMN 3:

Line 16, "an" should read --a--; and
Line 54, "cartridge" should read --cartridge 7--.

COLUMN 4:

Line 68, "include" should read --includes--.

COLUMN 6:

Line 44, "synchronous" should read --synchronism--;
Line 52, "charged" should read --charge--; and
Line 64, "has" should read --have--.

UNITED STATES PATENT AND TRADEMARK OFFICE

CERTIFICATE OF CORRECTION

PATENT NO. : 5,402,212

DATED : March 28, 1995

INVENTOR(S) : Ito et al.

It is certified that error appears in the above-indentified patent and that said Letters Patent is hereby corrected as shown below:

COLUMN 8:

Line 2, "the" (second occurrence) should be deleted;
Line 3, "adhered" should read --adhere--;

COLUMN 10:

Line 10, "21" should read --221--;
Line 44, "cartridge," should read --cartridge.--; and
Line 47, "to" should read --of--.

COLUMN 11:

Line 9, "other" should read --other end--;
Line 30, "temporality" should read --temporarily--;
Line 32, "from" (first occurrence) should be deleted;
Line 35, "informations" should read --information--;
Line 37, "are" should read --is--; and
Line 38, "these informations," should read --this information,--.

UNITED STATES PATENT AND TRADEMARK OFFICE

CERTIFICATE OF CORRECTION

PATENT NO. : 5,402,212

DATED : March 28, 1995

INVENTOR(S) : Ito et al.

It is certified that error appears in the above-indentified patent and that said Letters Patent is hereby corrected as shown below:

COLUMN 12:

Line 49, "members" should read --member--.

Signed and Sealed this

Twenty-fifth Day of July, 1995

Bruce Lehman

*Attest:*

BRUCE LEHMAN

*Attesting Officer*

*Commissioner of Patents and Trademarks*